US006309058B1

(12) United States Patent
Lecheheb et al.

(10) Patent No.: US 6,309,058 B1
(45) **Date of Patent: *Oct. 30, 2001**

(54) METHOD AND APPARATUS FOR CONTROLLING A MULTI-NOZZLE INK JET PRINTHEAD

(76) Inventors: Ammar Lecheheb, 3 The Paddock, Harston, Cambridge; Jerzy Marcin Zaba, 26 Melvin Way, Histon, Cambridge CB4 4HY; Ray Rijing Yu, 4 Robin Close, Bar Hill, Cambridge CB3 8DX, all of (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/331,446

(22) PCT Filed: Dec. 18, 1997

(86) PCT No.: PCT/GB97/03486

§ 371 Date: Aug. 20, 1999

§ 102(e) Date: Aug. 20, 1999

(87) PCT Pub. No.: WO98/28149

PCT Pub. Date: Jul. 2, 1998

(30) Foreign Application Priority Data

Dec. 23, 1996 (GB) ..... 9626707

(51) Int. Cl.[7] ..... B41J 2/02
(52) U.S. Cl. ..... 347/73

(58) Field of Search ..... 347/73, 74, 76, 347/80, 78

(56) References Cited

U.S. PATENT DOCUMENTS 4,800,396 * 1/1989 Hertz ..... 347/75
4,839,665 * 6/1989 Hertz et al. ..... 347/75

FOREIGN PATENT DOCUMENTS

WO 94/11193 * 5/1994 (WO) ..... B41J/2/115

* cited by examiner

*Primary Examiner*—N. Le
*Assistant Examiner*—Michael Ngheim
(74) *Attorney, Agent, or Firm*—Robert F. I. Conte; Lee, Mann, Smith, McWilliams, Sweeney & Ohlson

(57) ABSTRACT

A method of printing uses a multi-nozzle ink jet print head having a pressure modulator for causing streams of ink emitted from the nozzles to be broken up into individual droplets. The nozzles are divided into a plurality of groups of nozzles, and groups of charge electrodes correspond, each group of charge electrodes having a respective charge controller. In the method a modulation waveform is generated to operate the pressure modulator to cause droplets to be generated in each stream. The charge controllers are operated to supply a charge signal waveform to charge electrodes and charge droplets in the streams. The phase relationship of the charge signal waveform is adjusted relative to the modulation waveform.

2 Claims, 8 Drawing Sheets

METHOD AND APPARATUS FOR CONTROLLING A MULTI-NOZZLE INK JET PRINTHEAD

FIELD OF THE INVENTION

This invention relates to a method and apparatus for controlling a multi nozzle ink jet print head.

BACKGROUND OF THE INVENTION

There are two general types of ink jet printing, drop-on-demand (DOD) and continuous (CIJ). Drop-on-demand printing, as its name suggests, produces droplets of ink as and when required in order to print on a substrate. Continuous ink jet printing, to which the present invention relates requires a continuous stream of ink which is broken up into droplets which are then selectively charged; either charged or non-charged droplets are allowed to pass to a substrate for printing, charged droplets being deflected in an electric field either on to the substrate or into a gutter (according to design) where the non-printed droplets are collected for re-use. In the first case, the droplets are deflected by an electric field onto the substrate with the uncharged drops going straight on to be collected in a gutter for re-use. The amount of charge also determines the relative printed position of the drops. In the second case, the droplets are deflected into an offset gutter, with the printing drops being the uncharged ones going straight onto the substrate. The obvious advantage of printing with the uncharged drops is that, in a multi-jet printer where several drop generators are aligned perpendicular to a moving substrate, the alignment of the drops printed on the substrate is not dependent on the ability to accurately and uniformly charge the drops. As long as the charge on the droplets is sufficient for the drops to be deflected into the gutter aperture, small variations in the charge applied will not affect the quality of the resulting print. This second type of printer is generally known as a binary jet printer as the droplets are either charged or uncharged (and do not intentionally carry varying amounts of charge that determine print position).

In typical continuous ink jet printers, the print head has a droplet generator which creates a stream of droplets of ink by applying a pressure modulation waveform to the ink in a cavity in the print head and the continuous ink stream leaving the print head breaks up into individual droplets accordingly. This modulation waveform is usually a sinusoidal electrical signal of fixed wavelength. The stream of ink leaving the print head breaks up into individual drops at a distance tor time) from the print head commonly known as the break-up point, that is dependent on a n umber of parameters such as ink viscosity, velocity and temperature. Provided these and other factors are kept relatively constant, then a given modulation waveform will produce a consistent break-up length. In order to induce a charge on the droplet, the charging waveform must be applied to the stream at the moment before the drop separates from the stream, and held until the drop is free (ie. must straddle the break-up point). It therefore necessary to know the phase relationship between the modulating waveform and the actual drop separating from the stream (ie. during which part of the sinusoidal modulation waveform does break-up occur).

One method of determining this phase relationship involves a charge detector (and associated electronics), position somewhere after the charging electrode, which can detect which drops have been successfully charged. A half width charging pulse, progressively advanced by known intervals relative to the modulation waveform, is used to attempt to charge the droplets and the detector output analysed to determine correct charging. Because of the half width pulse, theoretically half the tests should pass and half should fail. The full width pulses used for printing would then be positioned to straddle the detected break-up point. The number of intervals that the waveform is divided into, and therefore the number of possible different phases, can vary from system to system, but usually the timing is derived from a common digital close signal, and therefore is usually a binary power (ie. could be 2, 4, 8, 16, 32 etc.). Typically, 2 and 4 intervals would not give sufficient resolution, and 32 intervals upwards would make the tests too time consuming. Using 16 intervals (ie. 16 different phases) is considered to give more than adequate accuracy without involving a detrimental number of tests.

In a multi-jet print, due to manufacturing tolerances of the nozzles and the characteristics of the (usually common) ink cavity, the break-up point for each of the streams, and therefore the phase setting for printing will be different.

Modern multi-jet printers, in order to be able to print high-quality graphics and true-type scalable fonts, utilise a large number of ink streams, placed very closely together (typically 128 jets at a spacing of 200 microns).

Although it has proved possible to manufacture charge electrodes at the required spacing, to individually charge the streams, it would not be practical to duplicate existing charge electrode driver circuitry 128 times, and so current trends lean towards the use of an integrated driver solution in which a large number of the drive circuits are implemented in one Integrated Circuit device, in order to save space, reduce power etc. With such a device, for practical reasons, it is not possible to enable, or set the level of charging voltage on an individual jet basis, and so all the high voltage drivers within the device have a common enable and common power supply.

Additionally, at present it is not possible to have a separate phase detector for each stream. The probability is that the individual detectors would never be able to isolate the charge from their own stream from the effects of any adjacent streams.

A final handicap to existing phasing methods being applied to this type of printer, is the fact that the "normal" condition for the droplet streams, ie. not printing, is for all the droplets to be charged. Therefore, to test individual jets would require the detection of the non-charged state, resulting in ink being sent to the substrate. Also, the phase detector circuitry would more than likely not be able to distinguish the change in charge passing the detector when a single jet was turned off, against a background of 127 jets still on.

Therefore conventional phase detection methods are not suitable for modern high-resolution binary CIJ printers.

In our British patent application no. 9626706.7 and our co-pending International patent application reference MJB05643WO we describe a method of phasing the jets at start-up which comprises generating a modulation waveform to operate the pressure modulator to cause droplets to be generated in each stream; and, independently for each group of charge electrodes:

- operating the respective charge controller to supply a charge signal waveform to each charge electrode in turn;
- adjusting the phase of the charge signal waveform relative to the modulation waveform between 0 and 360 degrees in a number of steps;
- determining the optimum phase relationship to achieve proper charging for each droplet stream in turn;

and thereafter adjusting the phase of the charge signal waveform relative to the modulation waveform to achieve charging of droplets in all the streams in the group simultaneously.

Thus, for each group of nozzles/charge electrodes, the phase of the charge signal waveform is adjusted independently of that of the other groups so that proper charging of droplets in all the streams can be achieved.

However, the phase relationship also has to be maintained during printing over long periods and parameters such as temperature and ink viscosity change during printing. This has previously required the print head to be stopped frequently for readjustment as, hitherto, it has not been possible to carry out phasing without stopping and re-starting the printer. Now, because uncharged droplets are used for printing, the method used at start-up cannot be used during printing (more accurately in pauses between actual print cycles) because, otherwise, unwanted droplets would be sent to the substrate and printed since it is not possible to move the gutter into and out of the 'catch-all' position in the short time between print cycles. Furthermore, the use of the half-width pulse waveform of the method exemplified in our British patent application no. 9626706.7, is not possible either since all non-printed droplets must be charged in order to be sent (deflected) to the gutter in its operative position and that waveform has segments in which there is no charge applied to droplets.

The present invention is directed towards overcoming these problems.

SUMMARY OF THE INVENTION

According to the present invention there is provided a method of printing using a multi-nozzle ink jet print head having a pressure modulator for causing streams of ink emitted from the nozzles to be broken up into individual droplets, the nozzles being divided into a plurality of groups of nozzles, and corresponding groups of charge electrodes, each group of charge electrodes having a respective charge controller, the method comprising, generating a modulation waveform to operate the pressure modulator to cause droplets to be generated in each stream;

operating the charge controllers to supply a charge signal waveform to the charge electrodes and charging droplets in the streams;

setting the phase relationship of the charge signal waveform relative to the modulation waveform; and, to adjust the phase relationship of the charge signal waveform relative to the modulation waveform, during the printing process, when droplets do not require to be printed, independently for the charge controller of each group of charge electrodes, carrying out the steps of:

(A) operating the charge controller to apply a DC voltage simultaneously to all the charge electrodes in the group to charge all the droplets to prevent printing;

(B) applying a pulse signal waveform to the charge electrode controller, to reduce the amplitude of the DC voltage periodically and temporarily to a level below that of the DC voltage but still sufficient to cause droplets to be deflected to avoid printing;

(C) sensing by means of a detector the aggregate level of charge applied to the droplets and generating signals representative thereof;

(D) from the signals generated in step (C), determining the phase relationship of the pulse signal waveform relative to the modulation waveform; and, (E) if the pulse signal waveform is delayed relative to the modulation waveform, advancing the pulse signal waveform relative to the modulation waveform or, if the pulse signal waveform is advanced relative to the modulation waveform, delaying the pulse signal waveform relative to the modulation waveform, to reset the phase relationship of the pulse signal waveform relative to the modulation waveform.

The method of steps (A) to (E) can be carried out in milliseconds, so that the phasing of each charge electrode controller can be adjusted/reset in turn, during the natural short pauses which occur during the printing process between print cycles, without affecting actual printing.

Thus, phasing of the complete set of charge controllers can be carries out in turn, during pauses in the printing process when printing is not occurring, without having to stop and re-start the printer and thus without having to carry out, again, the start-up phasing procedure described in our co-pending British patent application reference MJB05643GB, and which is preferably used to set the phase relationship of the pulse signal waveform relative to the modulation waveform initially.

The method relies on the fact that non-printable droplets can still be created by the application of a reduced charge—provided by the reduced amplitude charging waveform, the reduced charge still resulting in deflection of droplets into the gutter.

The sensing of the charge on the droplets is achieved through the use of a phase detector electrode disposed below the charge electrodes, for example as described in our British patent application no. 9626686.1 and our co-pending International patent application reference MJB05548WO.

One example of a method according to the present invention will now be described with reference to the accompanying drawings, in which:

The method described below includes a description of the set up of the phasing prior to printing as this is useful in explaining the concepts involved in phasing multi-jet printers.

Figure 1:
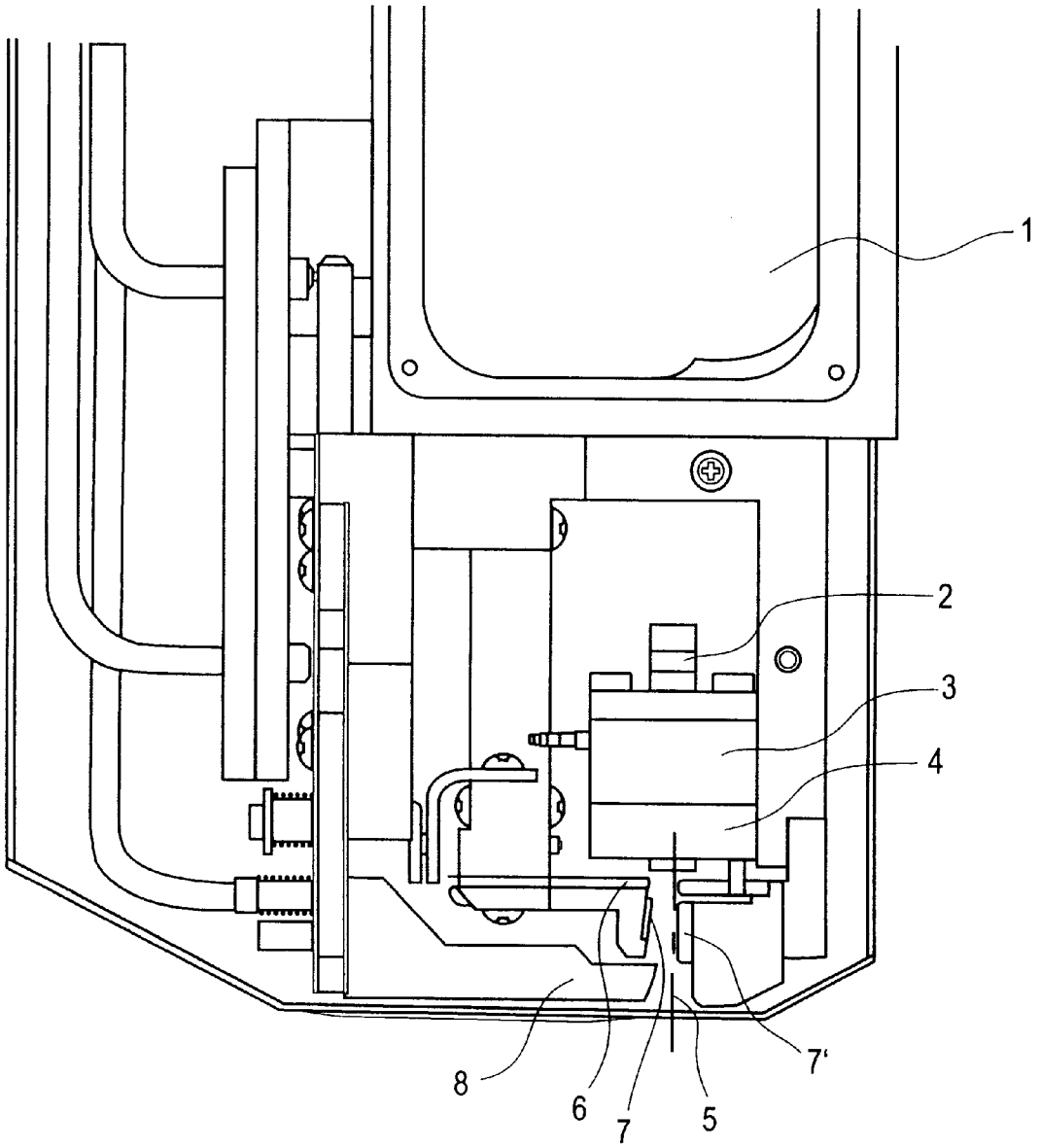
FIG. 1 is a side view of the print head of a multi-nozzle CIJ printer as described in our EP-A-0780231.

The print head shown in FIG. 1 is described in more detail in our EP-A-0780231. Since not all the features shown in FIG. 1 are relevant for a description of the present invention only the primary features will be referenced and described.

The print head has an electronics sub-system 1 by means of which are controlled the piezoelectric oscillator 2 forming part of a droplet generator 3 which has a nozzle plate 4 from which, in use, issue plural streams 5 of ink. The closely spaced nozzles are arranged in a row normal to the plane of the drawing. The streams of ink break up into individual droplets which pass respective charge electrodes 6 also arranged in a row in the same direction, where they are selectively charged and then passed between a pair of deflection electrodes 7, 7' which establish, in use, an electric field by means of which charged droplets are deflected from their straight-line path into a gutter 8. Formed in the face of the deflection electrode 7' is a phase detector electrode (not shown) which is used to detect the charge applied to droplets by the charge electrode 6. The phase detector electrode is described more fully in our British patent application no. 9626686.1.

Figure 3:
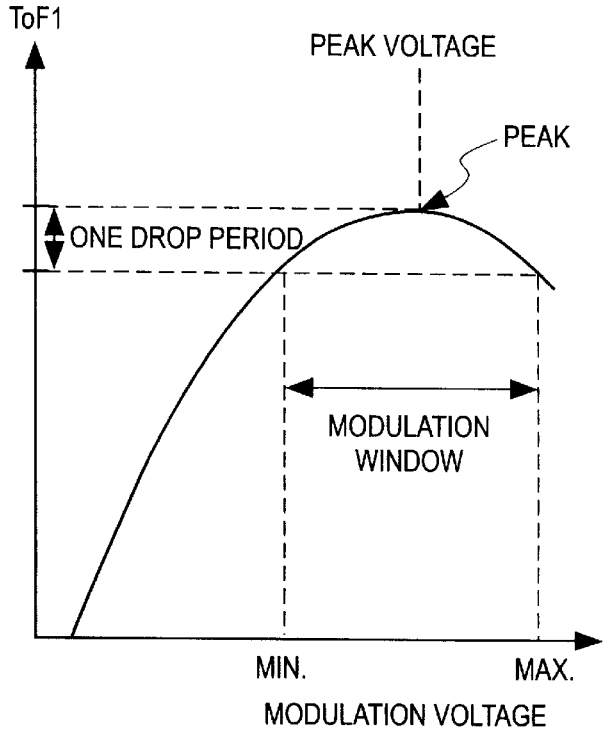
FIG. 3 illustrates a portion of the modulation voltage waveform applied to the droplet generator.
Figure 4:
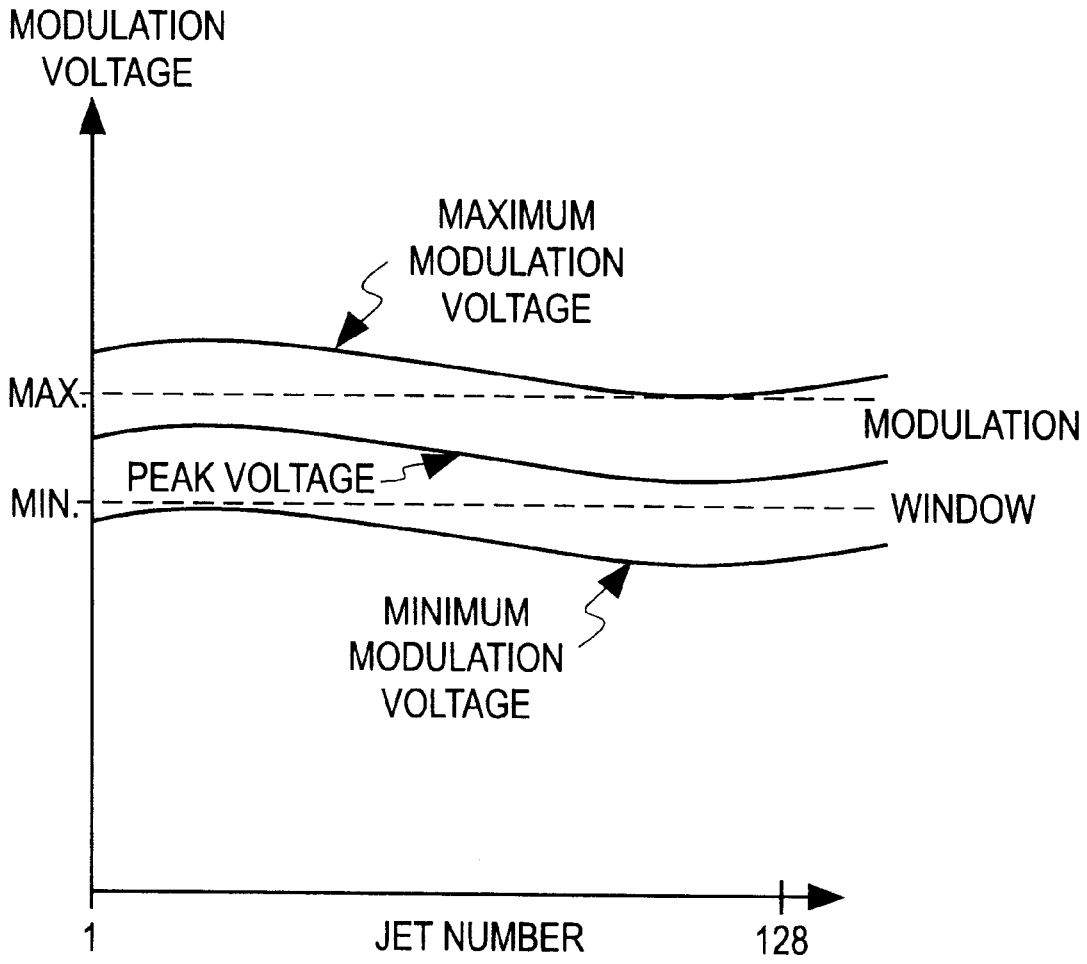
FIG. 4 illustrates an example of how the modulation window varies across the multiple nozzles in the print head.
Figure 5A:
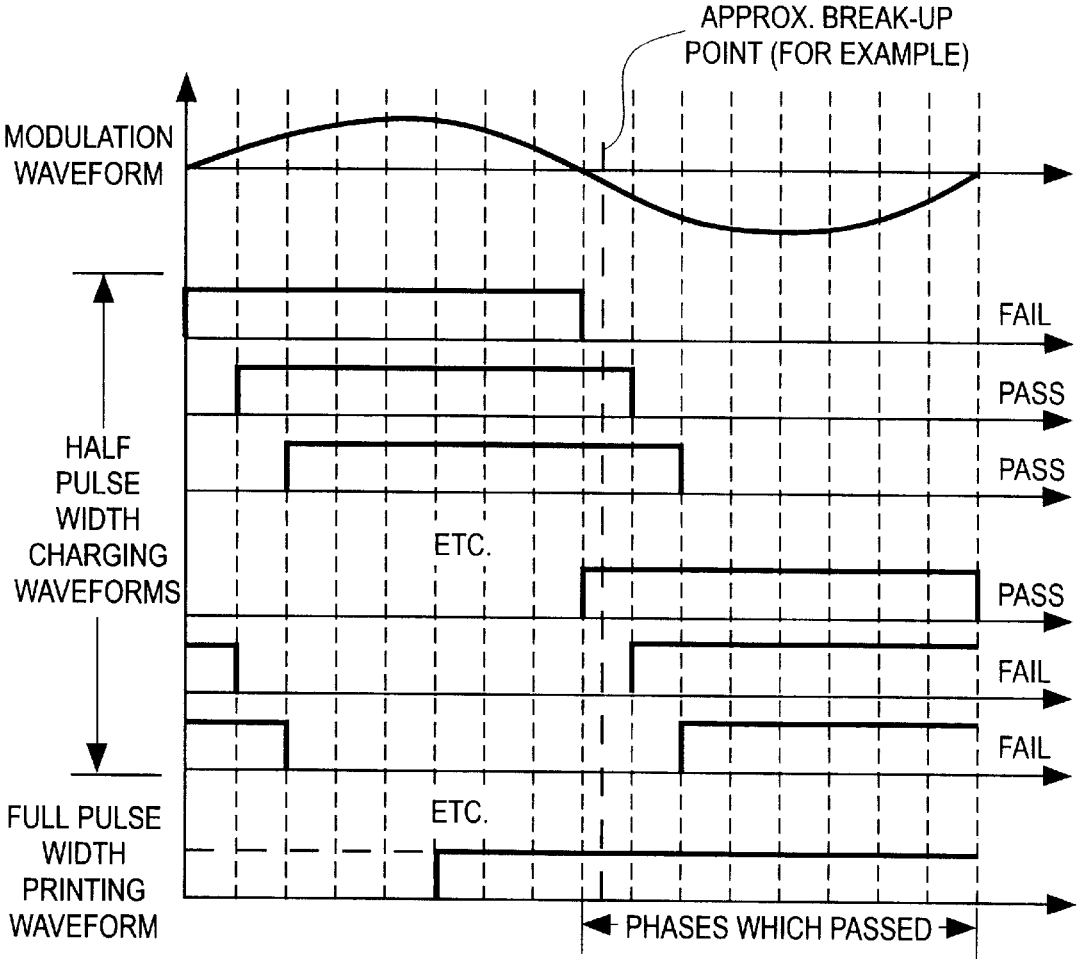
FIG. 5A illustrates examples of the possible spread of phase values.

The modulation waveform applied to the piezoelectric oscillator 2 and used to generate a corresponding pressure modulation within the droplet generator 3 so that the streams 5 of ink break up into droplets, is a sinusoidal electrical signal, part of which is shown in FIG. 3 and FIG. 5A. The amplitude of the modulation voltage is controlled from the electronics module 1 and can be set by appropriate software. As long as the ink parameters (composition, viscosity, temperature) are kept constant then a defined modulation waveform will produce a consistent drop break off pattern from each nozzle. This means that the time between the zero-point on the waveform and the time when the drop breaks away from the stream will be constant (ie. there is a constant phase relationship between the modulation waveform and the break up point of the ink stream). This fact can be used to set a fixed relationship between the charge waveform applied to the charge electrode 6 and the droplet break up rate. The charge electrode waveform and the modulation waveform are derived from a common system clock within the electronics module 1.

Figure 8:
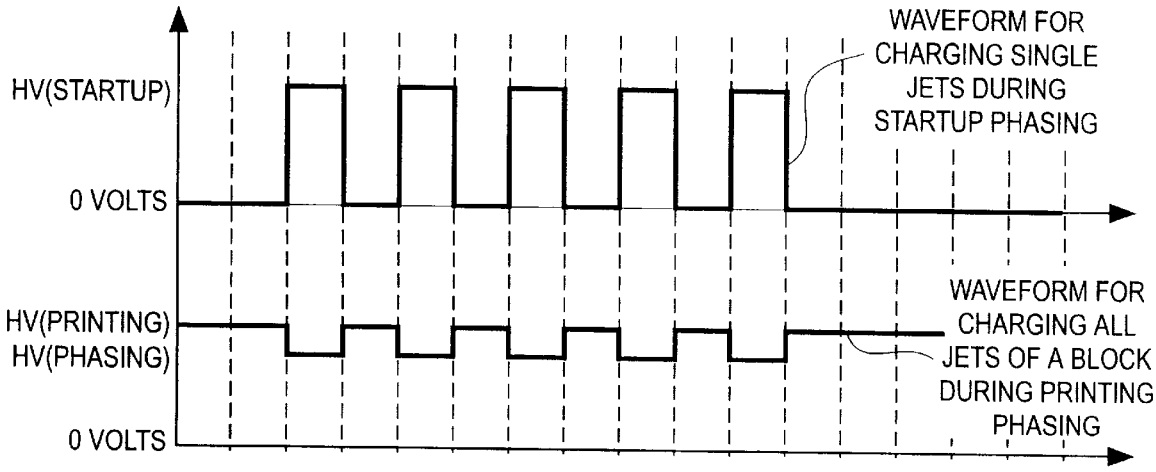
Figure 9:
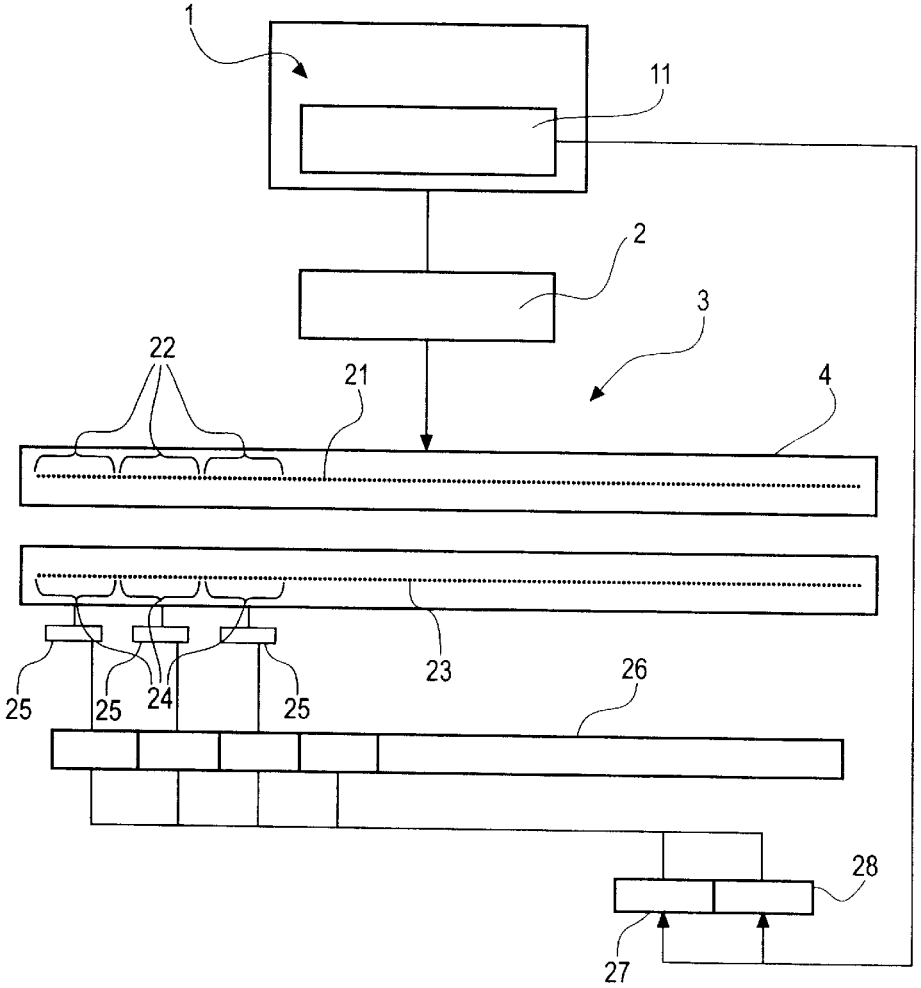
FIG. 9 illustrates in block form the apparatus of the present invention.

For the purposes of printing, the charge controller waveform (see FIGS. 2 & 8) is a digital or square waveform which has a value of 0 volts for droplets which are to be printed and a steady high voltage (in the region of 60–180 volts) for non-printable droplets. The transition between the two voltage values is very rapid (of the order of 0.5 microseconds). The phase of the charge controller waveform determines when the transition occurs between the two voltages.

Droplet charging arises from the fact that there is a small capacitance between the droplet being formed and the charge electrode. A voltage on the charge electrode thus causes a small displacement current to flow in the ink jet which forms a collection of charge on the droplet so that once the droplet has broken away from the stream it carries a charge which cannot change. A steady voltage on the charge electrode produces a continuous stream of charged droplets. In a similar way, 0 volts on the charge electrode 6 does not induce any charge on the droplet. Furthermore, an uncharged droplet cannot acquire any charge once it breaks off the stream so that a steady 0 volts on the charge electrode 6 will produce a stream of uncharged droplets.

Thus it will be appreciated how critical it is to the charging process that the droplet break-up point (determined by the pressure modulation waveform) is properly adjusted. This is described more fully in our British Patent Application no. 9626682.0 and our co-pending International Patent Application reference MJB05641WO.

During printing the charge electrode voltage has to be switched between 0 volts and the high voltage for a single drop period in order to allow a droplet to be printed. In order to produce a drop with no charge the charge electrode 6 has to be held at 0 volts while the drop breaks off and, ideally, the charge electrode 6 is kept at o volts for as long as possible on each side of the break off point. In practice, however, there is a limit to the time for which the charge electrode voltage can be held constant without interfering with the charge on the previous drop or that on the following drop and the optimum point for changing the charge electrode voltage is halfway between the break-off adjacent droplets.

In the printer of this example, to which the method of the present invention is applied, there are 128 nozzles (and a corresponding number of charge electrodes 6) which are, effectively, divided into 8 groups of 16. A single charge electrode controller is used to apply the appropriate charging waveform to each of the 16 charge electrodes in a group and thus 8 of these are provided.

Figure 2:
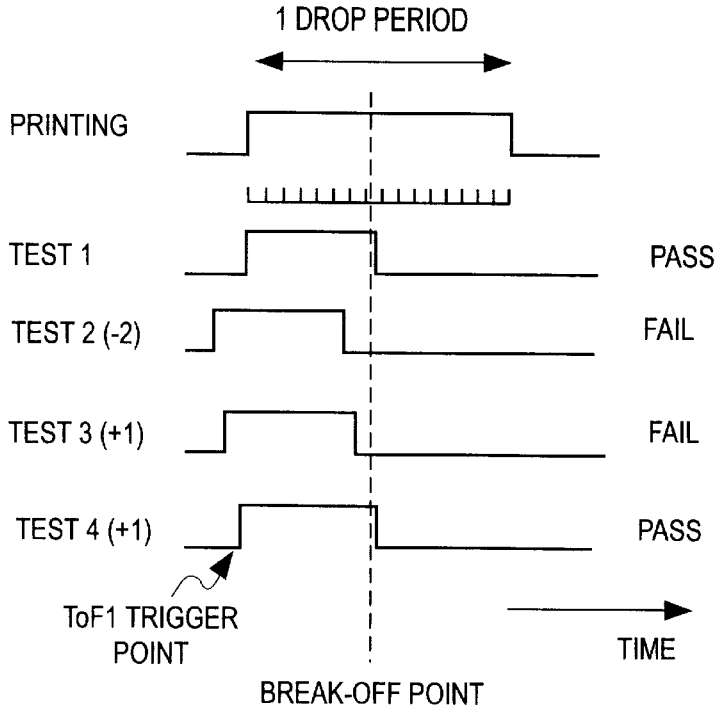
FIG. 2 is a diagram illustrating the process of start-up phasing.

As described above it is convenient to divide each drop period into 16 equal segments which allows the value of the charge electrode phase to have 16 possible values. In order to achieve the correct phasing to set up the printer prior to printing being started it has to be determined which phase value places the break-up point in the middle of the charging pulse. FIG. 2 illustrates this process.

At the top of FIG. 2 there is an indication of the width of a drop period ie. the time between adjacent droplets passing the charge electrode and immediately below that is a representation of the 16 possible phase values. Running down the middle of the figure is a dotted line representing (arbitrarily) the point at which the droplet breaks off. The charge electrode pulse is symmetric about the break up point in a temporal sense.

In order to carry out a phase test as part of the set-up procedure, the charge electrode pulse is reduced in width to exactly half the width of the normal pulse and is known as a half-width pulse. The half-width pulse starts at the same time as the full pulse but finishes halfway (at roughly the drop break-up point). If the break-up point is included within the half-width pulse then a charged drop will be produced which can be detected by the phase detector electrode referred to above and a positive result can be recorded within the electronics module 1. If the break-up point is not included in the half-width pulse then an uncharged drop will be produced and consequently there will be no detection of a charged drop by the phase detector electrode and the software will record a negative result. FIG. 5A illustrates how the half-width pulse can be scanned backwards and forwards across the break-up point in order to establish the position of the break-up point.

In this example, each of the 16 charge electrodes in each group has in turn, applied to it, a half-width pulse waveform which provides a series of charging pulses, while the remainder of the charge electrodes in the group have 0 volts applied. By this means, the phase detector electrode which monitors the value of charge applied to the droplets and which is common to all the droplet streams can be used to detect whether charge has been applied or not to the droplets generated in a single stream and thus determine the position of the break-up point relative to the charge controller waveform, ie. the phasing of the break-up point to the charging waveform.

Figure 5B:
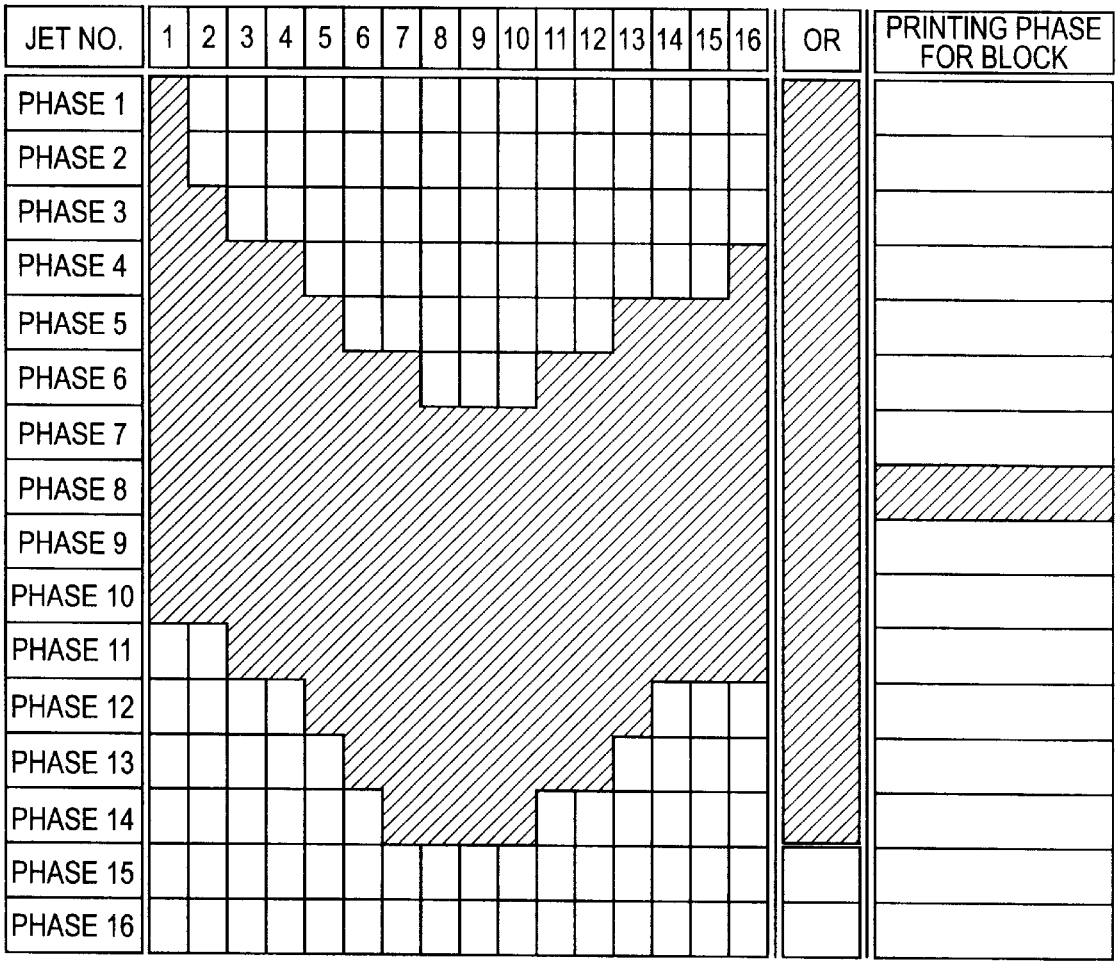
FIG. 5B illustrates an examples of the possible spread of phase values for a complete block or group of jets.

In practice it is found that there is, across the 16 droplet streams in each group, a spread of phase such as that illustrated in FIGS. 5A & 5B, and the charging waveform is adjusted appropriately so that the centre of the spread occurs substantially at the centre of the full width printing pulse of the charging waveform. This is achieved through appropriate software within the electronics module 1.

Figure 6:
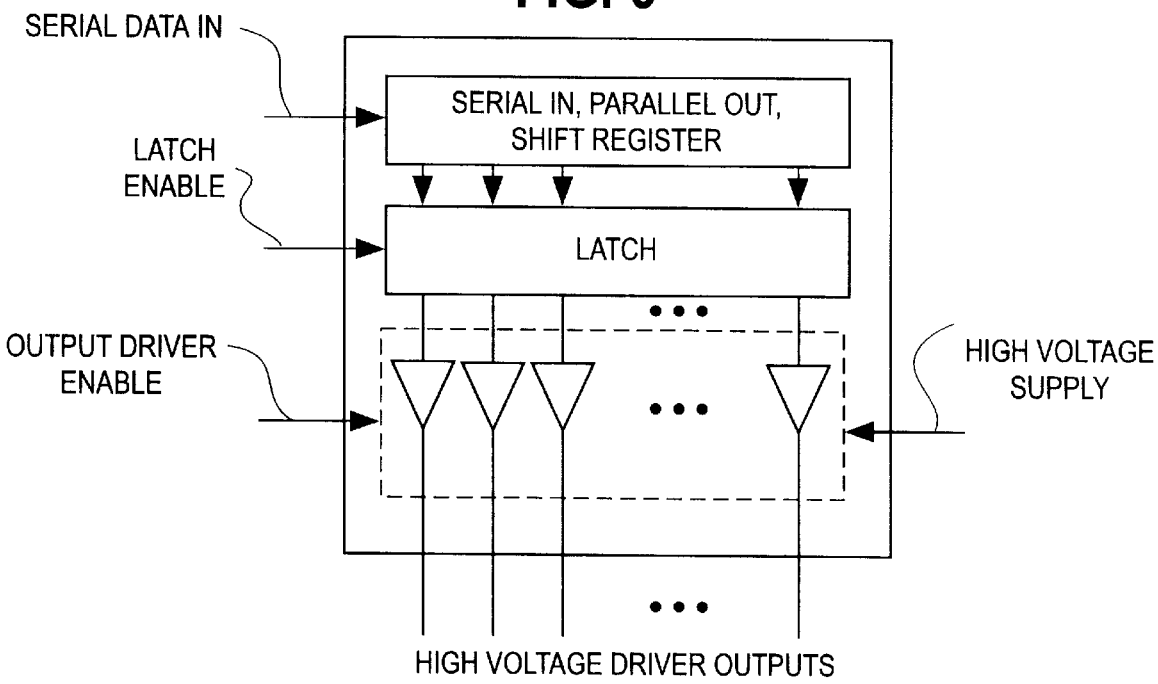
FIG. 6 illustrates the circuitry of a charge electrode controller.

In order to charge the electrodes from a single jet, the controlling electronics and/or software must write approximate printing data to the print head, prior to executing the phase tests. The data will be such, that only a single jet will be charged ie. will have only 1 bit out of 128 set to 1 (or 0 in the case of negative logic). If the data can be latched or held by the driver circuit (see FIG. 6), the same jet may be tested repeatedly, and at different phases, without the necessity of send more data, until the next jet requires testing. The enable of the driver device is simply pulsed with the phase timing charge signal.

The phase detector can then easily distinguish the phases which work for that jet and those that do not, because for those that do not there will be no charge at all passing the detector, as all the other jets are known to be uncharged.

In this example, where 128 jets are controlled by 8 driver devices (in blocks of 16), and the enables of those devices are individually controllable, the overhead of writing data can be still further reduced. Data can be written across the whole 128 bit width of the array, such that the corresponding bit is set in each block (ie. jets 1, 17, 33 . . . ). Phase tests can now be performed on jet 1 by pulsing only the enable to the device for block 1, jet 17 by pulsing the driver for block 2 etc. In all it would be possible to test 16 jets at all 16 phases, before it would be necessary to write new data.

In order to reduce the effect of an occasional erroneous result (for whatever reason), it is prudent to conduct the same tests a number of times, and taking an average of the results. For instance, test each jet at each phase four times, and only consider a phase as passed if 3 out of 4 (or all 4!) tests passed. Again, the four sets of tests on all phases on all corresponding jets in all blocks, could be completed before it would be necessary to write new data.

In the theoretical discussion that preceded, it was stated that because a half width pulse was used for the phase tests, that half of the phases should pass for any given jet, so in this example 8 should pass and 8 should fail. In practice, due to noise considerations, the number of passes may vary from the theoretical 8, but this should not affect the determination that the jet can be correctly phased and at what particular phase. However it should be checked that the phase for which a jet passes to constitute a contiguous group. A suitable algorithm for determining that a jet can be phased satisfactorily is that say between 4 and 12 phases results in passes, and that these are in a contiguous group, ie. passing on phases 2 to 11 represents a satisfactory jet. Passing on phases 2, 4, 6 and 8 to 12 does not, (even though there are 8 passes!) Having obtained a set of passes for a jet and determined that they are both sufficient and contiguous, the correct printing phase for that jet can be calculated, essentially by taking the mean of the phases passed, though in practice an empirically determined offset may be uniformly added. Since each group of 16 droplet streams can be phased in this way, each of the charge controllers can be synchronised to the modulation waveform to achieve accurate registration between drops printed from each of the nozzles.

Thus, the phasing of the charging waveforms for the 8 groups of charge electrodes can be set up prior to printing commencing.

Conventionally, during printing, it has not be possible to carry out phasing and therefore it has been normal to shut-down the printer at intervals during the day in order to carry out re-phasing in order to accommodate changes in the operating parameters and ambient conditions.

The method of carrying out phasing during the printing process is different from that used at start-up, because individual jets cannot be phased because of the requirement not to print the droplets used in phasing on to the substrate. Thus, all the jets in a group are effectively phased together by applying the same charge signal waveform to all the jets in the group and by adjusting its phase relationship with the modulation voltage. This means that all the jets in a group are treated as having the same phase relationship with the modulation waveform, even if this is not correct. In practice, it is unlikely, having phased the jets at start-up, that the spread of break-up lengths will be so great as to cause problems. FIG. 5 illustrates examples of the spreads which may occur. In the method of this example, and according to the invention, the power supply to the individual charge electrode controllers (one for each 16 jets as explained above) is reduced slightly (by say 10 or 20%), see FIG. 8, and a test pattern (identical charge signal waveforms each comprising a set of charging pulses) is applied to the charge electrodes, the charge waveform comprising half width pulses as in the start-up phasing method described above, but having a slightly lower value.

Figure 7:
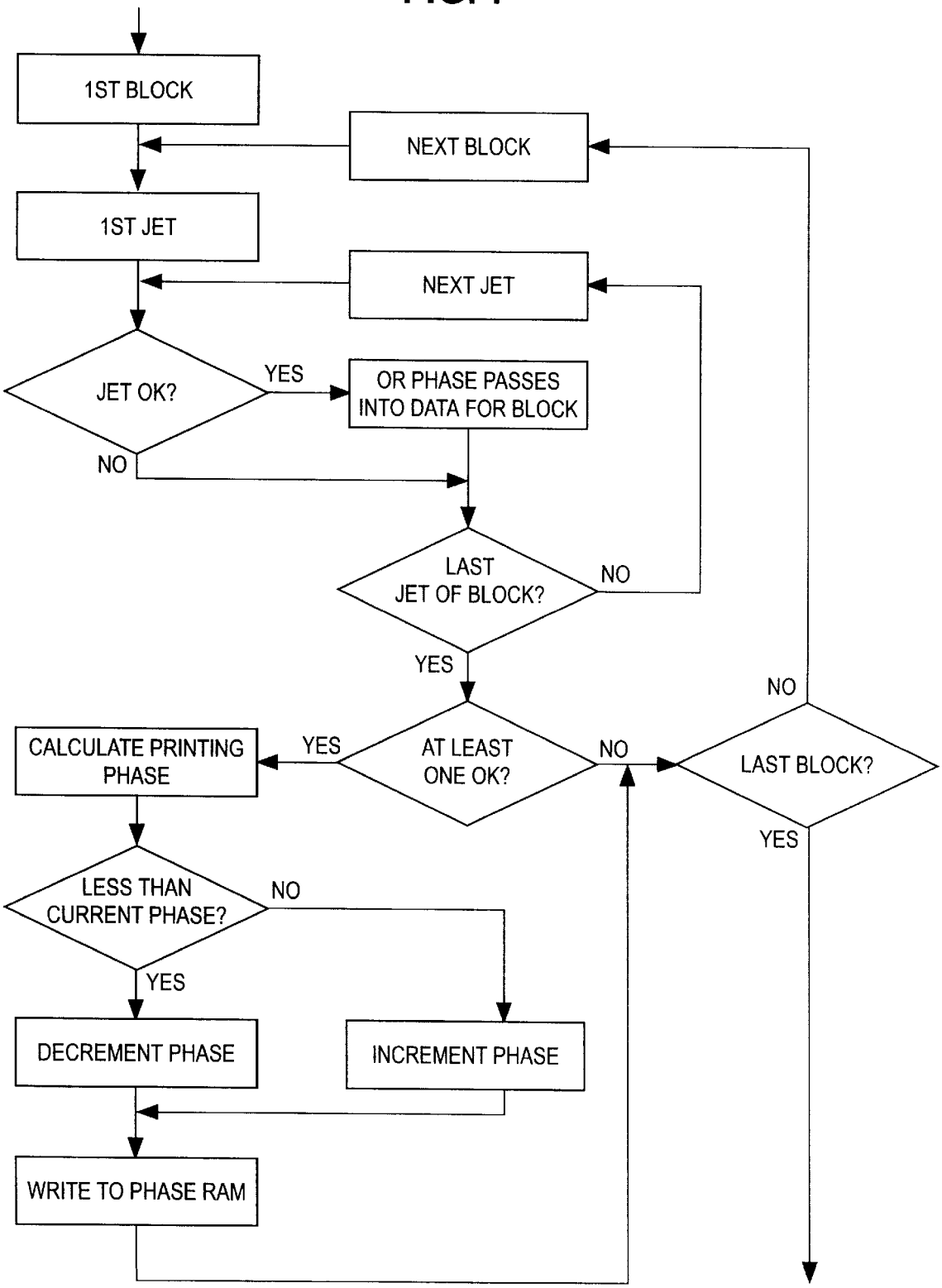
FIG. 7 is a flowchart illustrating the phasing procedure according to an example of the present invention; and, FIG. 8 is an illustration of waveforms suitable for charging single jets during start-up and suitable for charging all jets in a block or group during printing.

The flowchart of FIG. 7 describes the procedure to be followed according to this example, the flowchart illustrating the procedure as applied initially to the first of the eight blocks of 16 jets and, after completion of the phasing of each block, to the next. The phasing of the next block may occur after the printer has returned to actual printing, when the next pause occurs.

As with phasing at start-up, the table of phase 'passes' can be analysed (see FIG. 5B) to locate a suitable phase that will work for all jets in the group or block, the same requirements as to number and contiguity being observed. Once the mean of the phases that pass the test has been established, any required offset can be added.

Once the phasing has been established for each group of droplets, the printer continues its actual printing process. Since phasing can be carried out in a very short period of time (typically a few milliseconds), natural breaks in the actual printing of droplets on to the substrate can be used for the phasing method without the need to delay or otherwise affect the actual printing being carried out by the printer. This is a major advantage to operators.

What is claimed is:

1. A method of printing using a multi-nozzle ink jet print head having a pressure modulator for causing streams of ink emitted from the nozzles to be broken up into individual droplets, comprising:

dividing the nozzles into a plurality of groups of nozzles with each group of nozzles having more than one nozzle, providing corresponding groups of charge electrodes, with each group of charge electrodes having a respective charge controller, generating a modulation waveform during the printing to operate the pressure modulator to cause droplets to be generated in each stream;

operating the charge controllers during the printing to supply a signal waveform to the charge electrodes and charging droplets in the streams;

during the printing setting the phase relationship of the charge signal waveform relative to the modulation waveform; and, adjusting the phase relationship of the charge signal waveform relative to the modulation waveform, during the printing process, when droplets do not require to be printed, independently for the charge controller of each group of charge electrodes, by carrying out the steps of:

(A) operating the charge controller to apply a DC voltage simultaneously to all the charge electrodes in the group to charge all the droplets to prevent printing;

(B) applying a pulse signal waveform to the charge electrode controller, to reduce the amplitude of the DC voltage periodically and temporarily to a level below that of the DC voltage but still sufficient to cause droplets to be deflected to avoid printing;

(C) sensing the aggregate level of charge applied to the droplets and generating signals representative thereof;

(D) determining the phase relationship of the pulse signal waveform relative to the modulation waveform from the signals generated in step (C); and, (E) if the pulse signal waveform is delayed relative to the modulation waveform, advancing the pulse signal waveform relative to the modulation waveform or, if the pulse signal waveform is advanced relative to the modulation waveform, delaying the pulse signal waveform relative to the modulation waveform, to reset the phase relationship of the pulse signal waveform relative to the modulation waveform.

2. A multi-nozzle ink jet print head having:

a plurality of nozzles 21 divided into more than one group 22 of nozzles with each group of nozzles having more than one nozzle;

a piezoelectric actuator 2 for causing streams of ink emitted from the nozzles to be broken up into individual droplets;

a plurality of charge electrodes 23 divided into more than one group 24 of charge electrodes, each group of charge electrodes having a respective charge controller 25 positioned for each group of nozzles;

means 11 for generating a modulation waveform to operate the piezoelectric actuator 2 to cause droplets to be generated in each stream;

means 26 for operating the charge controllers to supply a charge signal waveform to the charge electrodes and charging droplets in the streams;

means 27 for setting the phase relationship of the charge signal waveform relative to the modulation waveform, adjusting means 28 for adjusting the phase relationship of the charge signal waveform relative to thc modulation waveform during the printing process when droplets do not require to be printed, said adjusting means operating independently for each group of charge electrodes, by:

operating the charge controller to apply a DC voltage simultaneously to all the charge electrodes in the group to charge all the droplets to prevent printing;

operating the charge controller to apply a pulse signal waveform to the charge electrode controller, to reduce the amplitude of the DC voltage periodically and temporarily to a level below that of the DC voltage but still sufficient to cause droplets to be deflected to avoid printing;

operating the charge controller to sense the aggregate level of charge applied to the droplets and generating signals representative thereof;

determining the phase relationship of the pulse signal waveform relative to thc modulation waveform from the generating signals; and, advancing the pulse signal waveform relative to the modulation waveform or, delaying the pulse signal waveform relative to the modulation waveform to reset the phase relationship of the pulse signal waveform relative to the modulation waveform if the pulse signal waveform is advanced relative to the modulation waveform.

* * * * *